US011655648B2

(12) United States Patent
Rausell

(10) Patent No.: US 11,655,648 B2
(45) Date of Patent: May 23, 2023

(54) PARKING PLATFORM FOR A MOTOR VEHICLE

(71) Applicant: Woehr Autoparksysteme GmbH, Friolzheim (DE)

(72) Inventor: Ignacio Vinas Rausell, Korntal-Muenchingen (DE)

(73) Assignee: Woehr Autoparksysteme GmbH, Friolzheim (DE)

( * ) Notice: Subject to any disclaimer, the term of this patent is extended or adjusted under 35 U.S.C. 154(b) by 332 days.

(21) Appl. No.: 16/871,348

(22) Filed: May 11, 2020

(65) Prior Publication Data

US 2020/0308861 A1 Oct. 1, 2020

Related U.S. Application Data

(63) Continuation of application No. PCT/EP2018/080766, filed on Nov. 9, 2018.

(30) Foreign Application Priority Data

Nov. 14, 2017 (DE) ..... 10 2017 126 699.2

(51) Int. Cl.
*E04H 6/26* (2006.01)
*E04H 6/42* (2006.01)

(52) U.S. Cl.
CPC ..... *E04H 6/26* (2013.01); *E04H 6/422* (2013.01)

(58) Field of Classification Search
CPC ..... B66F 7/24; B66F 7/28; E04H 6/12; E04H 6/26; E04H 6/422
See application file for complete search history.

(56) References Cited

U.S. PATENT DOCUMENTS 2,478,993 A * 8/1949 Wing ..... B62D 25/2054 52/579
2,742,121 A * 4/1956 Liskey, Jr. ..... E04C 2/427 52/180
2,754,014 A * 7/1956 Santochi ..... E04H 6/26 193/38

(Continued)

FOREIGN PATENT DOCUMENTS

CN 103321458 9/2013
DE 2228366 12/1973

(Continued)

*Primary Examiner* — James M Ference
(74) *Attorney, Agent, or Firm* — Lipsitz & McAllister, LLC

(57) ABSTRACT

The invention relates to a parking platform for a motor vehicle, in particular for a motorized parking apparatus for a motor vehicle. Profile parts are provided which are arranged next to each other along a longitudinal direction and preferably are connected to each other and form a parking space for the motor vehicle. The profile parts each comprise a base region and a projecting region projecting therefrom. In order to provide a generic parking platform with high stability and increased user friendliness for a vehicle operator, the profile parts each comprise a profile section which has at least one base region and at least one projecting region, as well as a covering section which is arranged next to the profile section and is connected thereto. The covering section of a profile part covers at least one projecting region of an adjacent profile part.

21 Claims, 10 Drawing Sheets

(56) References Cited

U.S. PATENT DOCUMENTS 2,815,872 A * 12/1957 Graham ..... E04H 6/065 414/229
3,531,902 A * 10/1970 Da Costa ..... E04C 2/08 52/588.1
3,841,776 A * 10/1974 Klaus ..... E04H 6/42 404/41
3,943,589 A * 3/1976 Pedersen ..... E04F 15/06 52/180
3,969,855 A * 7/1976 Lendi ..... E04H 6/06 52/177
4,073,110 A * 2/1978 Kennedy ..... E04C 2/30 52/579
4,125,340 A * 11/1978 Klaus ..... E01C 5/16 404/35
4,266,381 A * 5/1981 Deller ..... B62D 25/2054 52/592.4
5,067,866 A * 11/1991 Fusaro ..... E04H 6/06 414/234
2008/0206025 A1* 8/2008 Berger ..... E04H 6/245 414/227
2010/0089845 A1* 4/2010 Fassler ..... B66F 7/04 211/1.57
2015/0211233 A1* 7/2015 Pagadelz-Kiehl ..... B32B 15/14 428/184
2018/0118539 A1* 5/2018 Kritzer ..... B66F 7/28
2020/0071141 A1* 3/2020 Kritzer ..... B66F 7/0683
2020/0308861 A1* 10/2020 Rausell ..... E04H 6/422

FOREIGN PATENT DOCUMENTS

| | | | | |
|---|---|---|---|---|
| DE | 2342987 | | 10/1974 | |
| DE | 3236043 | | 3/1984 | |
| DE | 102006019592 | | 11/2007 | |
| DE | 102007023540 | A1 * | 11/2008 | ..... B66F 7/04 |
| DE | 202008012918 | | 1/2009 | |
| EM | 000311055-001 | | 3/2005 | |
| EM | 000311055-002 | | 3/2005 | |
| EM | 000311055-003 | | 3/2005 | |
| EM | 000311055-004 | | 3/2005 | |
| EM | 000311055-005 | | 3/2005 | |
| EM | 000311055-006 | | 3/2005 | |
| EP | 0881343 | | 12/1998 | |
| RU | 2624474 | | 7/2017 | |
| SU | 613041 | | 8/1978 | |

* cited by examiner

PARKING PLATFORM FOR A MOTOR VEHICLE

CROSS-REFERENCE TO RELATED APPLICATIONS

This application is a continuation application of international application number PCT/EP2018/080766, filed on Nov. 9, 2018, and claims the benefit of German application number 10 2017 126 699.2, filed Nov. 14, 2017, which are incorporated herein by reference in their entirety and for all purposes.

FIELD OF THE INVENTION

The present invention relates to a parking platform for a motor vehicle, in particular for a motorized parking apparatus for a motor vehicle, which parking platform comprises profile parts which are arranged next to each other along a longitudinal direction and preferably are connected to each other and form a parking space for the motor vehicle, wherein profile parts are provided which each comprise a base region and a projecting region projecting therefrom.

BACKGROUND OF THE INVENTION

A parking platform of this kind is used, for example, in a motorized parking apparatus for the motor vehicle which, in an advantageous embodiment, comprises a lifting device for the parking platform, whereby the latter is selectively lifted and lowered in order to condense available space for parking. Provision may hereby be made in particular for the parking apparatus to have a plurality of parking platforms which may be selectively connected to an entrance. A parking apparatus of the latter kind, though in which details of the parking platform are not disclosed, is described in DE 10 2006 019 592 A1.

In order to increase the stability of the generic parking platform, it comprises profile parts with a respective base region and a projecting region projecting therefrom. It is hereby known, for example, for a respective projecting region to be of substantially trapezoidal configuration in cross section. Profile parts arranged next to each other in the longitudinal direction of the parking platform (coinciding with a longitudinal direction of the motor vehicle positioned thereon) may be connected to each other at the base regions thereof. Profile parts of that kind are described in the Community design no. 000311055. Said profile parts and the parking platforms built therefrom have proven themselves in practice. It is also known for the profile parts to comprise a plurality of base regions and projecting regions arranged therebetween, for example profile parts with three to five projecting regions are used, said projecting regions being configured in accordance with the aforementioned design.

Profile parts of the kind stated above may preferably be connected to each other for increasing the stability. Alternatively or in addition, an attachment on side cheeks of the parking platform on which the lifting device of the parking apparatus engages is conceivable. For increasing the stability, the side cheeks may be connected to each other by way of connecting elements like, for example, a transverse support of the parking platform.

U.S. Pat. No. 5,067,866 describes a parking platform of a parking apparatus with one single profile part extending over the entire length of the parking platform. A further parking platform is disclosed in DE 23 42 987.

An object underlying the present invention is to provide a generic parking platform with high stability and increased user friendliness for a vehicle operator.

SUMMARY OF THE INVENTION

In an aspect of the invention, a parking platform for a motor vehicle, in particular for a motorized parking apparatus for a motor vehicle, is provided, which parking platform comprises profile parts which are arranged next to each other along a longitudinal direction and preferably are connected to each other and form a parking space for the motor vehicle. Profile parts are provided which each comprise a base region and a projecting region projecting therefrom. The profile parts each comprise a profile section which has at least one base region and at least one projecting region, as well as a covering section which is arranged next to the profile section and is connected thereto. The covering section of a profile part covers at least one projection region of an adjacent profile part.

BRIEF DESCRIPTION OF THE DRAWINGS

The foregoing summary and the following description may be better understood in conjunction with the drawings figures, of which.

DETAILED DESCRIPTION OF PREFERRED EMBODIMENTS OF THE INVENTION

Figure 1:
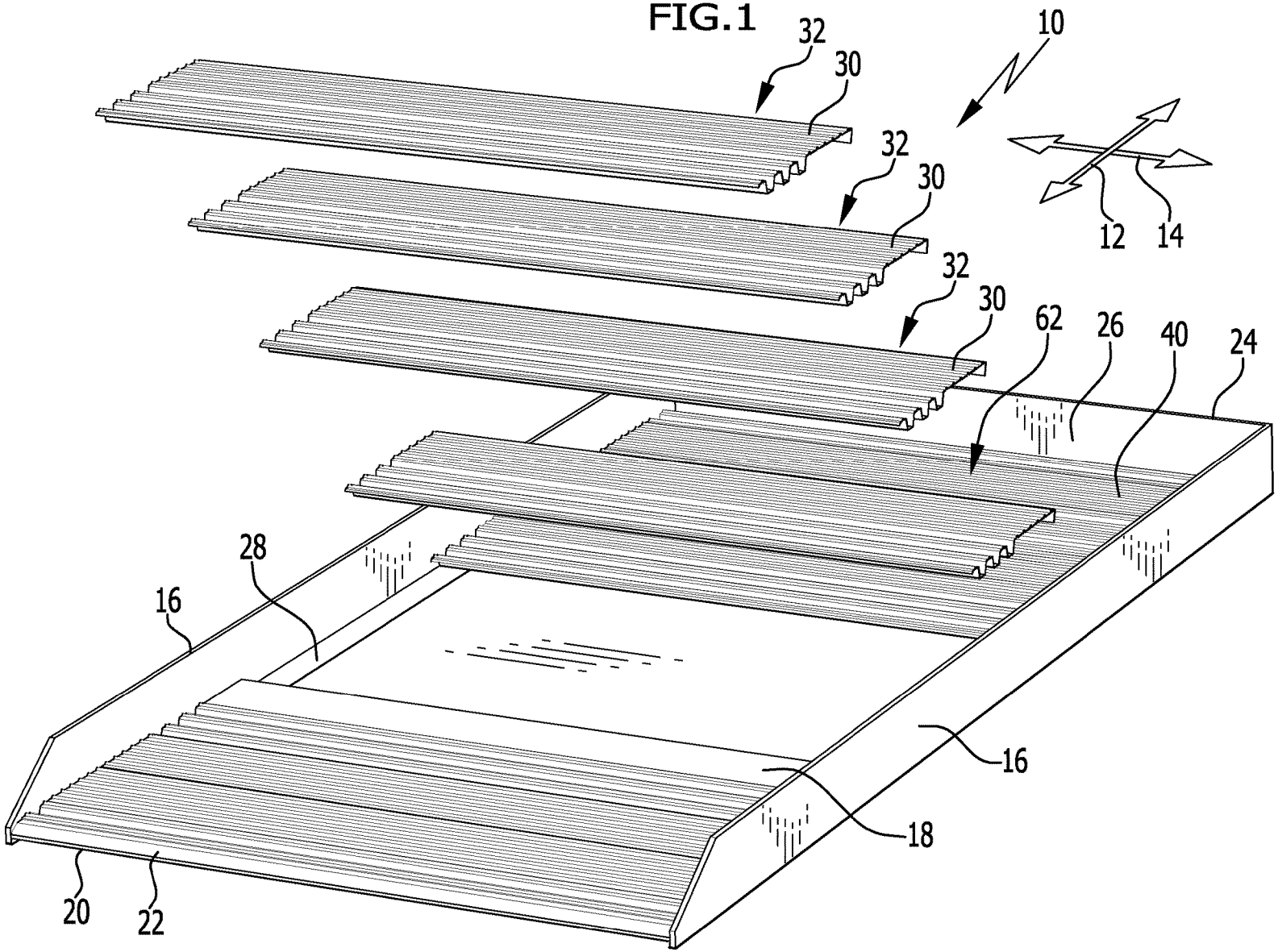
FIG. 1: shows a perspective view, partially in an exploded view, of a preferred embodiment of a parking platform in accordance with the invention.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a parking platform for a motor vehicle, in particular for a motorized parking apparatus for a motor vehicle, which parking platform comprises profile parts which are arranged next to each other along a longitudinal direction and preferably are connected to each other and form a parking space for the motor vehicle. Profile parts are provided which each comprise a base region and a projecting region projecting therefrom. The profile parts each comprise a profile section which has at least one base region and at least one projecting region, as well as a covering section which is arranged next to the profile section and is connected thereto. The covering section of a profile part covers at least one projection region of an adjacent profile part.

The parking platform in accordance with the invention comprises two sections. A profile section has at least one projecting region and one base region. The covering section of the profile part is arranged laterally adjacent thereto, in the longitudinal direction of the parking platform. The covering section is configured such that at least one projecting region of the profile part adjacent to the first-mentioned profile part is covered. As a result of the profile sections of the profile parts, the parking platform has a high mechanical strength and is secured against bending due to vehicles even with a large mass. Due to the covering sections, it is possible to provide the parking platform at the top, at least partially and preferably completely, with a closed or substantially closed parking space for the motor vehicle. As a result, the vehicle operator can walk on the parking platform better. For example a possible risk of tripping on projecting regions may be reduced. Moreover, the bearing capacity of the parking platform is also increased by the covering sections that are present in addition to the profile sections.

In an advantageous embodiment, the profile parts are made from a metal sheet, and in particular are formed in one piece. The profile section and the covering section are preferably connected to each other in one piece. The profile parts are advantageously made from planar base bodies, in particular from sheet metal, by means of bending or folding.

It is favorable if the covering section covers at least one projecting region and at least one adjoining base region of the adjacent profile part. The closed portion of the parking space for the motor vehicle may be increased in this way.

In order to increase the closed portion of the parking space for the motor vehicle, it is advantageous if the profile parts comprise a plurality of projecting regions and respective base region arranged therebetween, and if the covering section covers all projecting regions and respective base regions of the adjacent profile part arranged therebetween.

In particular, it is advantageous if the covering section covers the entire profile section of the adjacent profile part.

The covering section advantageously rests on the profile section of the adjacent profile part. For example, the covering section rests on at least one projecting region and favorably all projecting regions of the adjacent profile part. The stability of the parking platform is thereby increased.

In an advantageous implementation of the parking platform in accordance with the invention, it is favorable if the profile parts have a connecting region which connects the profile section and the covering section to each other, and if the covering section abuts with an abutment region, preferably in surface-to-surface contact, against the connecting region of the adjacent profile part. For example, when the parking platform is used as intended, the connecting region extends from a lower base region upwards to the covering section. The connecting region may be aligned in parallel to at least one leg of a projecting region. The abutment region of the adjacent profile part abuts, preferably in surface-to-surface contact, against the connecting region in order to increase the load capacity of the parking platform through mutual support of the profile parts.

It is advantageous if the covering section of a profile part adjoins the covering section of the adjacent profile part and if the parking space is substantially closed between the covering sections. The profile parts are advantageously dimensioned such that mutually adjoining covering sections are separated from each other by only a relatively small gap, in relation to the dimensions of the covering sections. For example, a gap between adjacent sections is approximately in the centimeter range and is preferably approximately 0.5 cm to 2 cm. A substantially closed parking space may thereby be provided in the region of adjoining profile parts.

It proves to be favorable if the covering section is of plate-shaped or substantially plate-shaped configuration at least in sections. As a result, it is easier for the vehicle operator to walk on the parking space. A plate-shaped or substantially plate-shaped configuration includes the advantageous property described below that profile elements, for example beads, are arranged on the covering section.

It is favorable if the extent of the profile section and the extent of the covering section in the longitudinal direction are the same or are substantially the same.

In an advantageous implementation, provision is made for the profile parts to have a first end on which a projecting region of the profile section is arranged, which is covered by the covering section of the adjacent profile part. At the first end of the profile part, a covering section of the adjacent profile part may project over the projecting region and cover the same. In the present embodiment of the parking platform, no base region is arranged on the first end.

In an advantageous implementation of the parking platform, provision is made for the profile parts to have a second end on which an abutment region of the covering section is arranged for abutting against a connecting region of the adjacent profile part. In this embodiment, the abutment region preferably abuts in surface-to-surface contact against the connecting region of the adjacent profile part on the second end, which connecting region connects the profile section to the covering section.

The at least one projecting region may, for example, be of trapezoidal, rectangular, or inverse trapezoidal configuration in cross section. In the trapezoidal configuration, the cross section of the projecting region tapers toward the top in the direction pointing away from the base region. In the rectangular configuration, the cross section of the projecting region remains constant. In the inverse trapezoidal configuration, the cross section of the projection region increases toward the top. In this case, the profile section may have a dovetail-shaped cross section between adjacent projecting regions.

The projecting regions of a profile part advantageously have an identical cross sectional shape. The cross sectional shapes of the profile parts are favorably identical.

It proves to be favorable if the profile parts are extended along a transverse direction of the parking platform, wherein the covering section covers the at least one projecting region of the adjacent profile part, preferably along the entire extent in the transverse direction. The advantages stated at the outset may in this way be achieved along the entire extent of the parking platform in the transverse direction.

In an advantageous implementation of the parking platform in accordance with the invention, provision may be made for the profile parts to comprise more than one projecting region, in particular two projecting regions or three projecting regions. A base region may be arranged between respective projecting regions. As described above, a projecting region may be arranged on a first end of the profile part. Two or more base regions of a profile part may preferably be of identical configuration.

Two or more profile parts arranged next to each other may advantageously be of identical configuration. Production costs for the parking platform may thereby be kept low.

An advantageous embodiment of the parking platform is a single parking space platform and has side cheeks between which the profile parts are arranged and on which the profile parts are fixed. A motor vehicle may be parked on the single parking space platform.

A different advantageous embodiment of the parking platform is a double parking space platform and has side cheeks and a longitudinal support, wherein profile parts are arranged in each case between a side cheek and the longitudinal support. The profile parts may be fixed on a respective side cheek and the longitudinal support.

The profile parts are favorably configured as folded sheet metal parts.

It is advantageous if the profile parts on the covering section and/or on at least one projecting region comprise or form at least one profile element. The at least one profile element increases the stability of the profile part at the covering section and/or at at least one projecting region. Arranged on the covering section, the at least one profile element can improve the accessibility of the profile part, for example by a possible risk of the vehicle operator slipping being reduced.

Profile elements may advantageously be beads on the covering section and/or on the at least one projecting region. Other kinds of profile elements like, for example, nubs are also conceivable.

Provision may be made for bead-shaped profile elements to be extended along the entire extent of the parking platform in the transverse direction.

In an advantageous embodiment of the parking platform, provision may be made for profile elements, which are arranged on the projecting region of a profile part and on the covering section of the adjacent profile part, to interengage. In a way, a "toothing" of the profile parts may be achieved by way of the profile parts, and the stability of the parking platform may thereby be increased.

Profile parts may be oriented projecting upwards or downwards from the projecting region and/or covering section.

FIG. 1 shows in a perspective view, partially in an exploded view, an advantageous embodiment of a parking platform in accordance with the invention, designated as a whole with the reference numeral 10. The parking platform 10 is a single parking space platform for accommodating a motor vehicle not depicted in the drawing. In particular, the parking platform 10 may be a constituent part of a motorized parking apparatus for the motor vehicle. For this purpose, a lifting device, for example of hydraulic configuration, may be provided on the parking platform 10 for raising and lowering the parking platform.

The parking platform 10 defines a longitudinal direction 12 and a transverse direction 14 aligned transversely thereto. When used as intended, the longitudinal direction 12 coincides with a longitudinal direction of the motor vehicle when the latter is aligned to the parking platform 10.

The parking platform 10 comprises two side cheeks 16 which are spaced relative to each other in the transverse direction 14 and are connected to each other by means of a transverse support 18. The side cheeks 16 are connected to each other by way of a connecting element 22 at a front end 20 at which the motor vehicle can drive onto the parking platform 10. At the rear end 24 that is opposite the front end 20, the side cheeks 16 are connected to each other by means of a further connecting element 26. The side cheeks 16 comprise bearing elements 28 facing toward the respective other side cheek 16.

The parking platform 10 comprises a plurality of profile parts 30 arranged next to each other in the longitudinal direction 12. The profile parts 30 each extend between the side cheeks 16 and rest, at least in part, on the bearing elements 28 thereof. The profile parts 30 are advantageously connected to the bearing elements 28. A connection of adjacent profile parts 30 to each other is advantageously effected such that at the same time a connection of the profile parts 30 to the bearing elements 28 also takes place. It is conceivable for adjacent profile parts 30 to be connected to each other without being simultaneously connected to the bearing elements 28.

The connection of profile parts 30 to each other and/or to the bearing elements 28 is preferably effected by means of screwing or riveting. Alternatively or in addition, a substance-to-substance bond may be provided.

The profile parts 30 are associated with two groups of profile parts, wherein the profile parts 30 of the first group are arranged between the connecting element 22 and the transverse support 18 and the profile parts 30 of the second group are arranged between the transverse support 18 and the connecting element 26.

In the present case, not all profile parts 30 of the parking platform 10 are configured identically. The profile parts 30 comprises profile parts 32, the configuration of which will be described in the following with reference in particular to FIGS. 2 to 4 and which each comprise a profile section 34 and a covering section 36. In addition, the profile parts 30 comprise profile parts 38 and profile parts 40, the configuration of which will be discussed thereafter (depicted only in FIG. 2).

The profile parts 32 comprise the profile section 34 and the covering section 36 connected thereto by way of a connecting region 42. The covering section 36 is arranged next to the profile section 34 in the longitudinal direction 12.

The profile section 34 extends from a first end 44 of the profile part 32 in the longitudinal direction 12 to the connecting region 42, and the covering section 36 extends from the connecting region 42 in the longitudinal direction 12 to a second end 46 which is located opposite the first end 44. The profile section 34 and the covering section 36 are substantially of equal length in the longitudinal direction 12.

The profile section 34 has base regions 48 which presently are of planar configuration and preferably define a common plane. Moreover, the profile section 34 has projecting regions 50. The projecting regions 50 are arranged between base regions 48, wherein a projecting region 50 is arranged at the first end 44. Starting from the first end 44, the projecting region 50 is thus followed by a base region 48, a further projecting region 50, a further base region 48, a further projecting region 50, and a further base region 48 that is connected to the connecting region 42. The profile parts 32 therefore have three projecting regions 50.

Two or more projecting regions 50 and/or two or more base regions 48 are preferably of identical configuration.

The projecting regions 50 are presently trapezoidal, having legs 52 which extend upwards commencing from the base regions 48 and which are connected to each other at the top by way of a top element 54. The trapezoidal cross section of the projecting regions 50 is regular, the legs 52 being equal in the magnitude of the incline relative to the base regions 48 and being of equal length.

Arranged at the first end 44 is a projecting region 50 which does not comprise a falling leg 52 commencing from the top element 54, but rather only a shoulder 56 thereof.

The connecting region 42 extends corresponding to one of the legs 52 of the adjacent projecting region 50, such that it substantially corresponds in form and function with said projecting region 50. However, the connecting region 42 is somewhat longer than the leg 52.

The covering section 36 adjoins the connecting region 42 in the longitudinal direction up to the second end 46. The covering section 36 is substantially planar and defines a plane which is aligned in parallel to the plane defined by the base regions 48.

At the second end 46, the covering section 36 comprises an abutment region 58 which is configured corresponding to the connecting region 42 of the adjacent profile part 32. The abutment region 58 extends downward from the covering section 36 to the base region 48 of the adjacent profile part 32 and is aligned in parallel to the connecting region 42 thereof.

The profile parts 32 and also the profile parts 38 and 40 are presently configured by means of folded metal sheets and are formed in one piece.

In the parking platform 10 in accordance with the invention, the stability and the user friendliness may be increased by the profile parts 32 each comprising a profile section 34 and a covering section 36. For assembling the parking platform 10, adjacent profile parts 32 are arranged partially one above the other such that the covering section 36 of a profile part 32 covers at least one projecting region 50 of the adjacent profile part 32.

Figure 3:
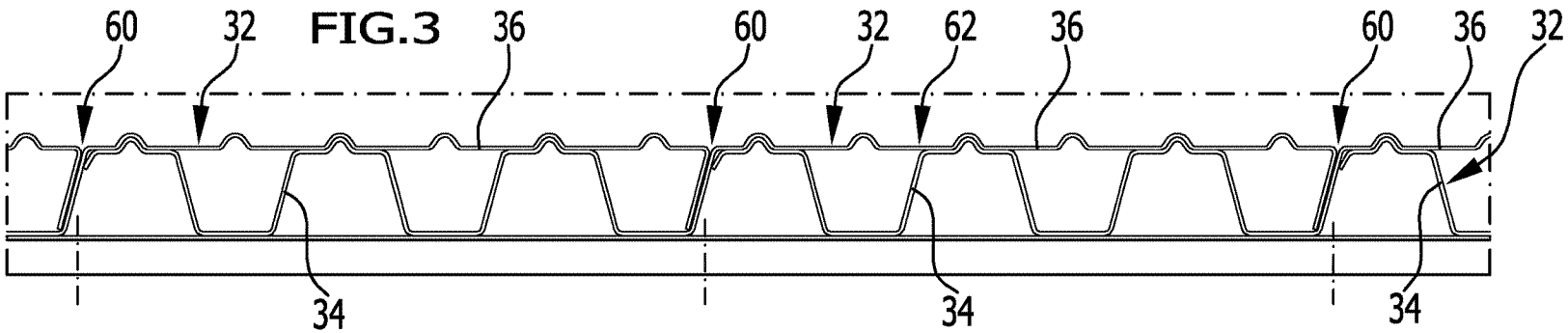
FIG. 3: shows an enlarged depiction of detail A in FIG. 2, which shows a plurality of profile parts of the parking platform.
Figure 4:
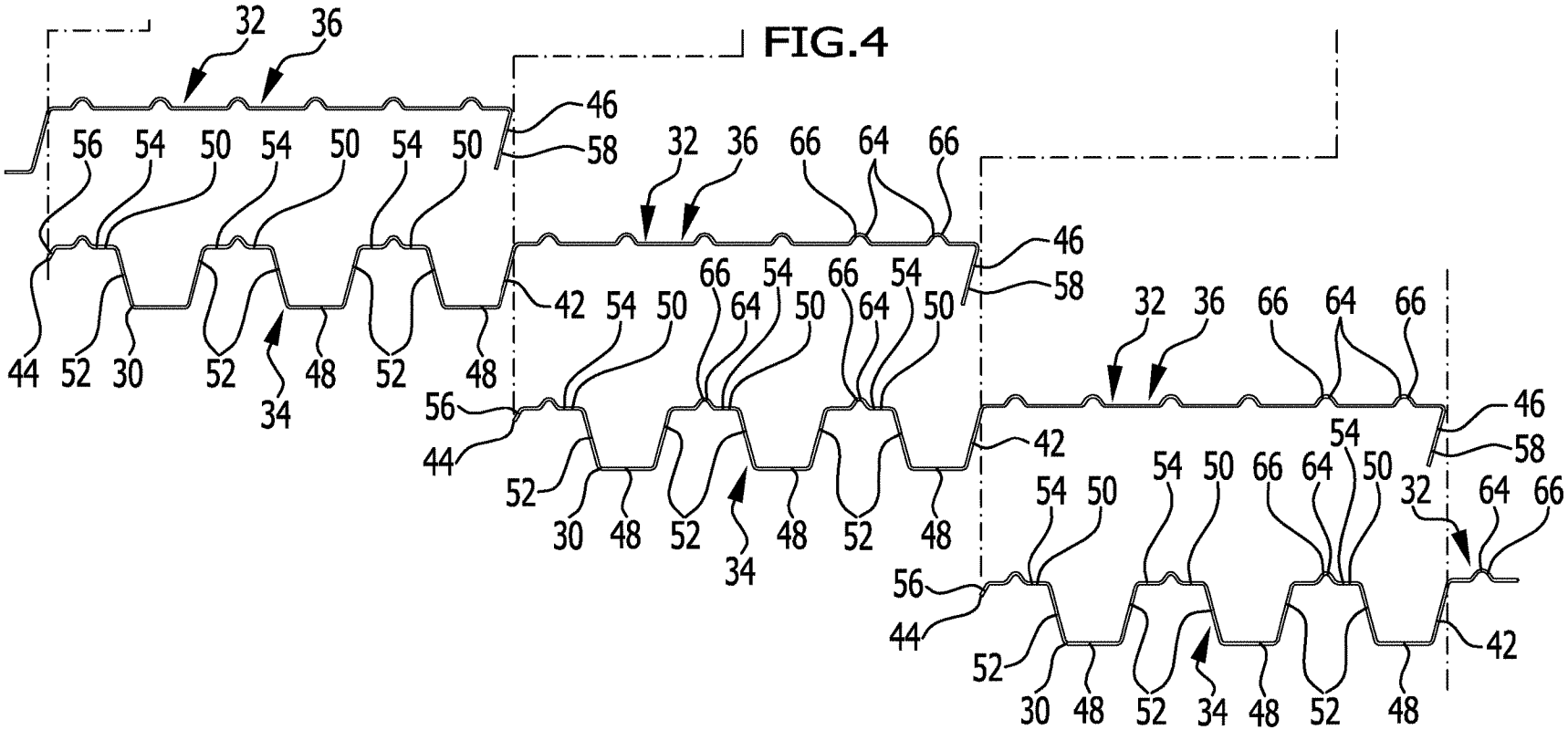
FIG. 4: shows profile parts of the parking platform in an enlarged exploded depiction.

In particular, the covering section 36 covers the entire profile section 34 of the adjacent profile part 32 (FIGS. 3 and 4). The covering section 36 may thereby rest at the top on at least one projecting region 50 and preferably all projecting regions 50, in particular the top elements 54 thereof, of the adjacent profile part 32. The abutment region 58 may abut in surface-to-surface contact against the connecting region 42 of the adjacent profile part 32. The shoulder 56 of the next profile part 32 abuts against the opposite side of the connecting region 42. A particularly stable construction of the parking platform 10 is ensured in this way.

The covering sections 36 are dimensioned such that only a small gap 60, for example in the centimeter range, is present between adjacent covering sections 36 (FIG. 3). This makes it possible to provide a substantially closed parking space 62 for the motor vehicle by means of the profile parts 32.

The substantially planar covering sections 36 and the parking space 62 formed by the same enable a vehicle operator to walk on the parking platform 10. Feet have more space and better grip than with conventional parking spaces formed only by trapezoidal profile parts. The risk of the vehicle operator tripping on the projecting regions 50 is reduced.

Furthermore, in the case of the parking platform 10, for increasing the stability and for reducing the risk of slipping, profile elements 64 are present on the projecting regions 50 and the covering sections 36. The profile elements 64 are presently configured as beads 66, which are preferably formed along the entire extent of the profile parts 30 in the transverse direction 14. The height of the beads 66 is significantly less than the height of the projecting regions 50, such that, even where beads 66 are present, the covering section 36 is still substantially planar.

In the case of the parking platform 10, the beads 66 are formed centrally in the longitudinal direction 12 on the top elements 54 of the projecting regions 50. The beads 66 are arranged on the covering sections 36 in such a way that they are aligned to the beads 66 on the projecting regions 50 of an adjacent profile part 32 (FIG. 3). This leads to a kind of "toothing" of the adjacent profile parts 32 while increasing the stability of the parking platform 10.

In the case of the parking platform 10, the profile parts 32 extend commencing from the transverse support 18 in the direction of the connecting element 26 in such a way that a covering section 36 adjoins a profile section 34 in the longitudinal direction 12. Starting from the transverse support 18 a profile section 34 is followed in the direction of the connecting element 26 by a covering section 36. However, the orientation of the profile parts 32 could also be reversed in the case of the profile parts of the first and/or the second group.

Adjacent to the transverse support 18, the parking platform 10 comprises the profile parts 38 already mentioned. The profile parts 38 comprise covering sections 68 for covering the profile sections 34 of the adjoining profile parts 32 adjacent to the transverse support 18. The covering sections 68, too, may comprise abutment regions for abutting against a connecting region 42 and a leg 52 of the profile section 34, respectively. The covering sections 68, too, may comprise profile elements, for example in the form of beads.

Adjoining the connecting element 22 and the connecting element 26, the parking platform 10 comprises the profile parts 40 already mentioned. In the present case, the profile parts 40 are formed like conventional profile parts with base regions 48 and projecting region 50, which have a trapezoidal cross section. Adjoining the connecting element 22 and the connecting element 26, the parking platform 10 may comprise profile parts with covering sections, which cover the connecting regions 50 arranged at the end (not shown).

In the following, further preferred embodiments of a parking platform in accordance with the invention will be described. Identical reference numerals are used for like or functionally equivalent features and components. The advantages mentioned in conjunction with the description of the parking platform 10 can likewise be achieved with the further parking platforms. Reference may be made to the preceding remarks in this regard. Therefore, only the substantial differences will be discussed in the following.

Figure 5:
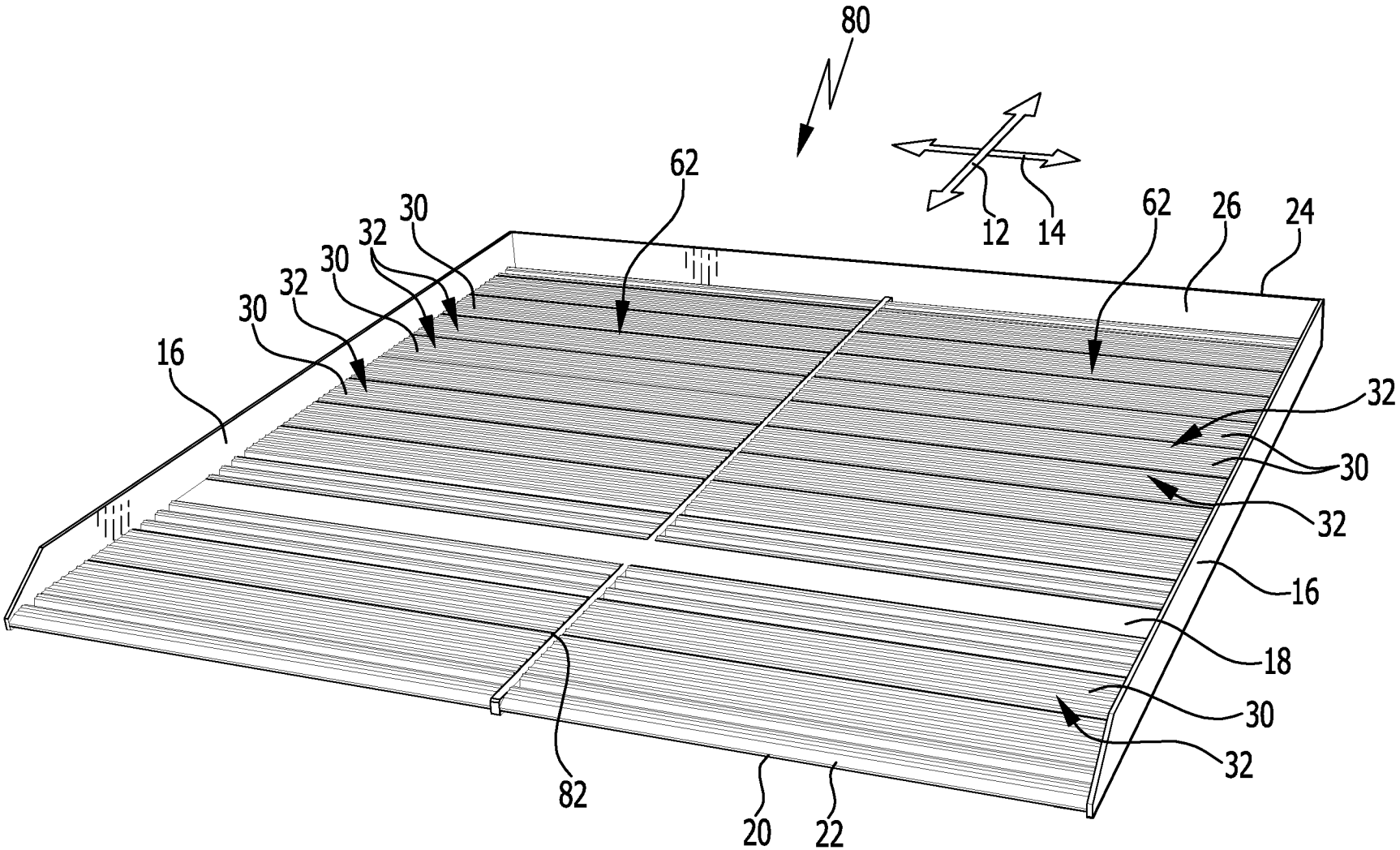
FIG. 5: shows a perspective depiction of a second preferred embodiment of a parking platform in accordance with the invention.

A parking platform 80 depicted perspectively in FIG. 5 is a double parking space platform on which two motor vehicles can be parked. The parking platform 80 comprises a longitudinal support 82 arranged centrally between the side cheeks 16, wherein the profile parts 30 each extend between the longitudinal support 82 and one of the side cheeks 16.

Figure 2:
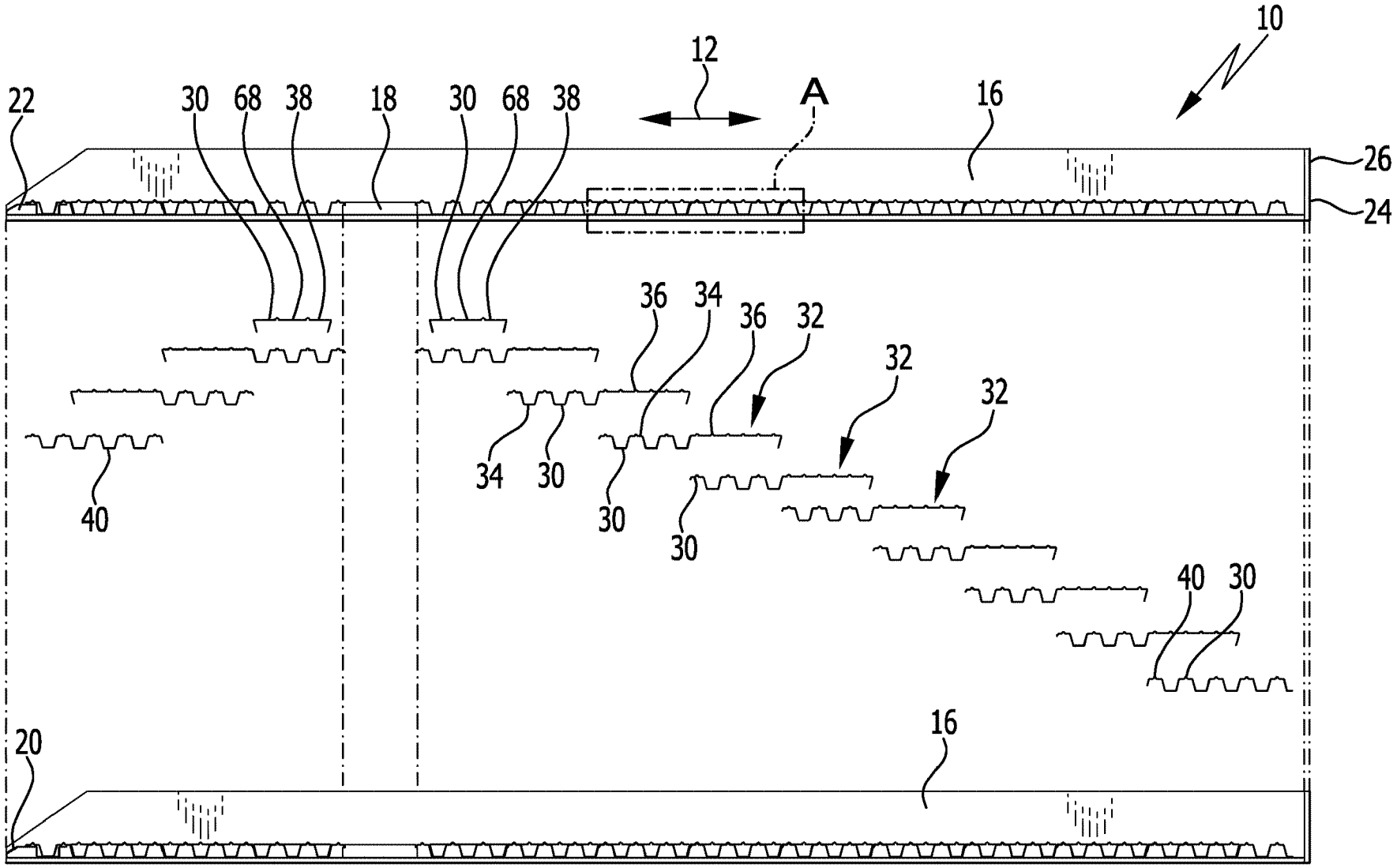
FIG. 2: shows a schematic view of the parking platform from FIG. 1 in an exploded view from the side.
Figure 6:
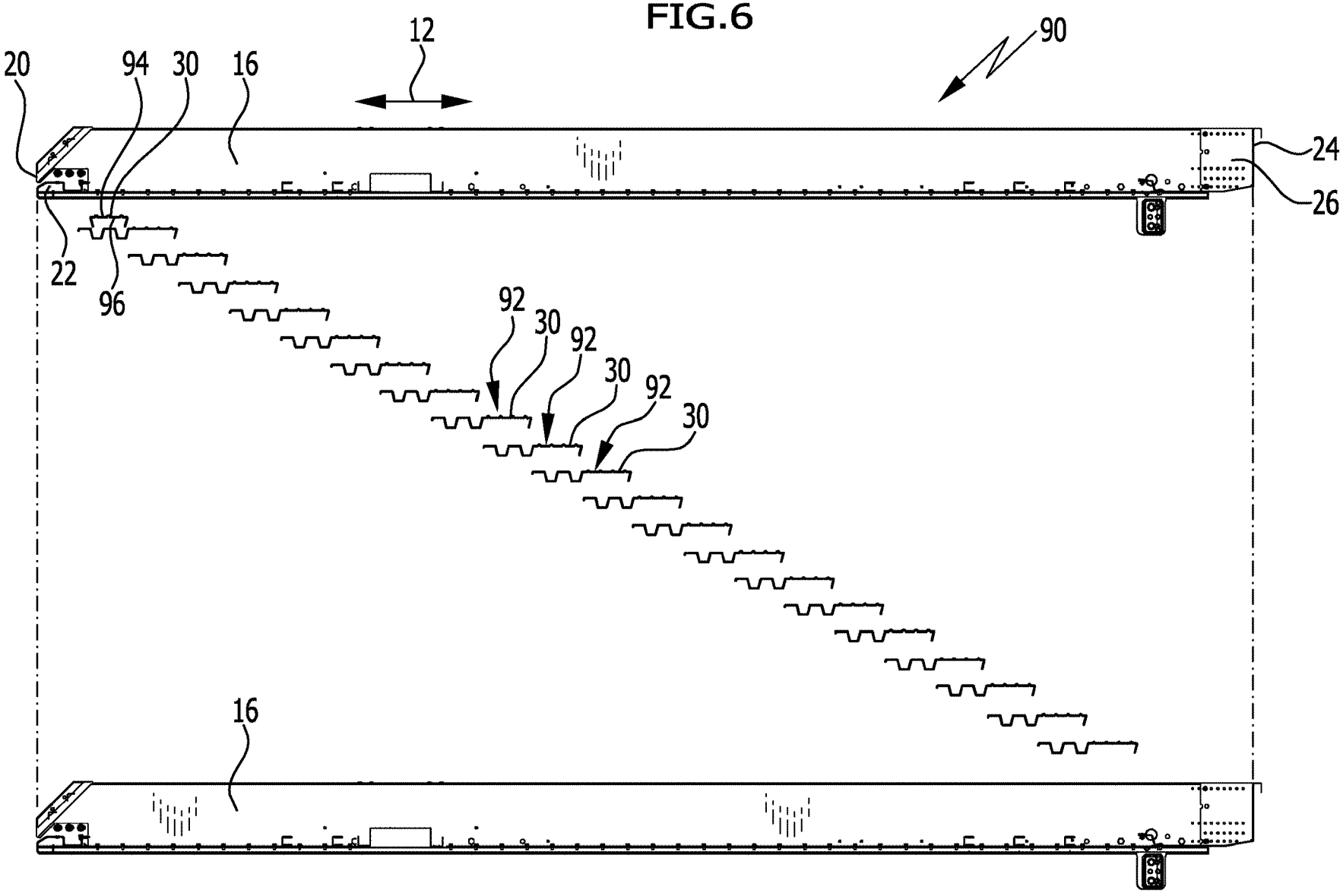
FIG. 6: shows a depiction corresponding to FIG. 2 in a third preferred embodiment of a parking platform in accordance with the invention.

In a manner corresponding to FIG. 2, FIG. 6 shows an advantageous embodiment of a parking platform in accordance with the invention, designated with the reference numeral 90. The parking platform 90 comprises the side cheeks 16 and the connecting elements 22, 26 connecting the latter. Profile parts 30 extend in the transverse direction 14 between the side cheeks 16.

Figure 7:
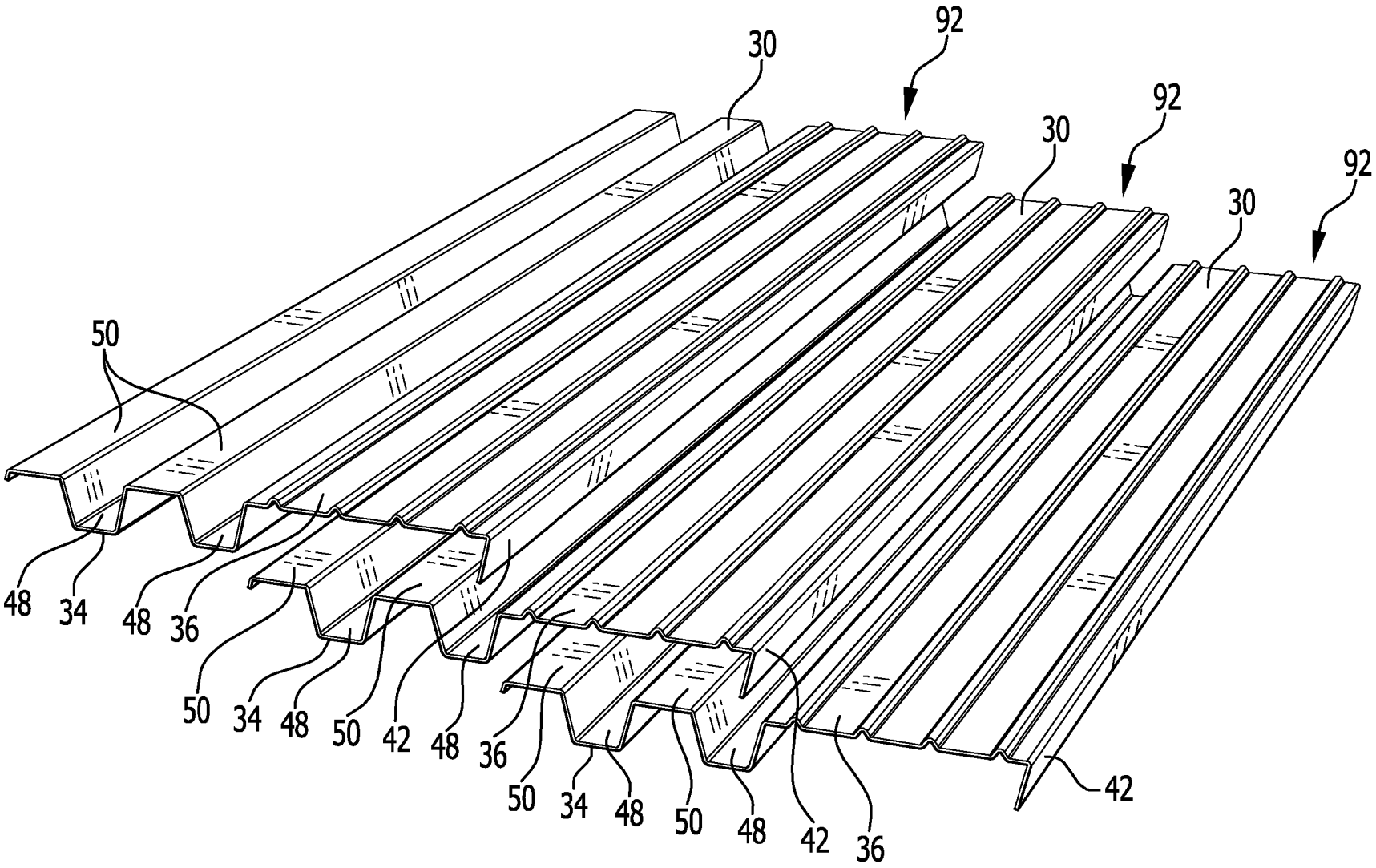
FIG. 7: shows profile parts of the parking platform in FIG. 6 in a perspective exploded view.
Figure 8:
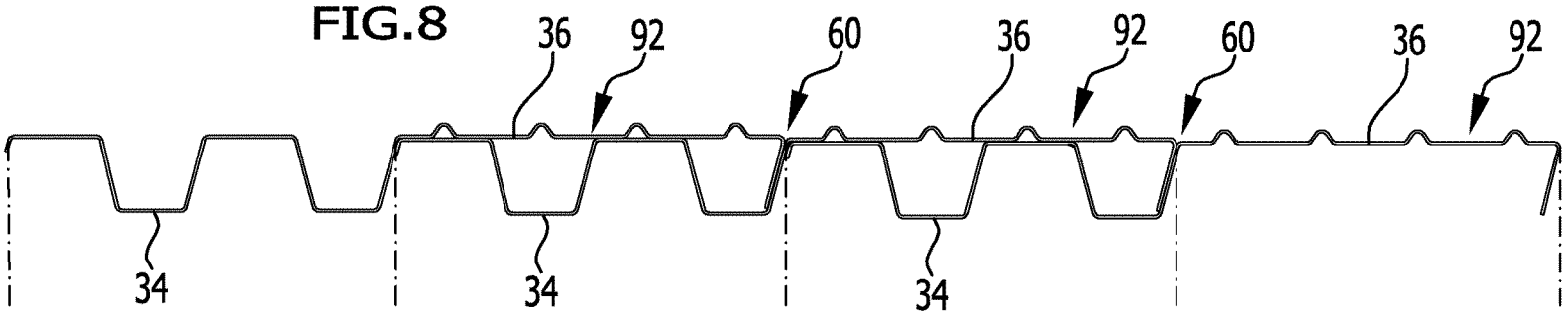
FIG. 8: shows a depiction corresponding to FIG. 3 with the parking platform from FIG. 6.
Figure 9:
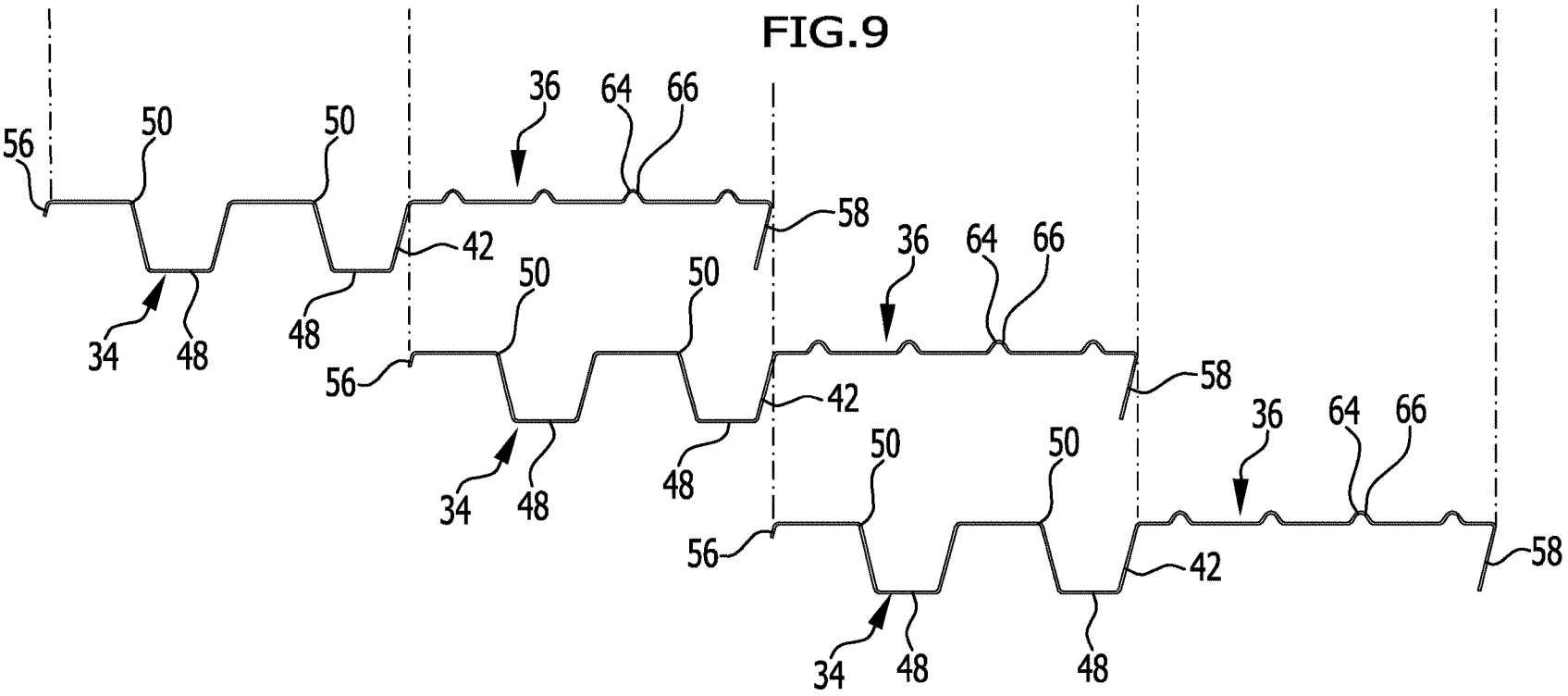
FIG. 9: shows the profile parts in FIG. 8 in an exploded view.

The profile parts 30 presently comprise profile parts 92 which, like the profile parts 32, each have a profile section 34 and a covering section 36. Unlike the profile parts 32, the profile parts 92 are dimensioned differently in that the respective profile section 32 does not have three projecting regions 50, but rather only two projecting regions 50. In a corresponding manner, the covering sections 36 in the case of the profile parts 92 are of smaller extent in the longitudinal direction 12 than the profile parts 32. However, the profile parts 92 are also dimensioned such that the covering section 36 of a profile part 92 completely covers the profile section 34 of the adjacent profile part 92 and rests on the projecting regions 50 thereof (FIGS. 7 to 9).

Unlike the parking platform 10, in the parking platform 90 a greater amount of material is required for the manufacture of the profile parts 92. This increases its stability, however. Moreover, because the profile parts 92, with otherwise identical manufacturing parameters, are formed shorter in the longitudinal direction 12 than the profile parts 32, the folding of the metal sheets is made easier, such that the requirements for the manufacturing tools are reduced.

Unlike the profile parts 32, the profile parts 92 on the projecting regions 50 are not provided with profile elements 64. The profile elements 64, also in the form of beads 66, are present only on the covering sections 36. In the case of the parking platform 90, too, a non-slip parking space 92 is formed which is easy to walk on and is substantially closed by the adjoining covering sections 36.

In the case of the parking platform 90, the profile parts 92 are oriented such that a covering section 36 adjoins a respective profile section 34 commencing from the connecting element 22 to the connecting element 26. However, the profile parts 92 may also be oriented in the reverse direction. Adjacent to the connecting element 24, a profile part 94 may be provided with a covering section 96 for covering the profile section 34 of the profile part 92 nearest the connecting element 22 (FIG. 6). Said profile part 94 may have abutment regions for abutting against the connecting region 42 and a leg 52 of the profile section 34.

In the following, with reference to FIGS. 10A to 15D, different configurations of profile parts 32 will be discussed, which may be used in a parking platform in accordance with the invention.

Figure 10A:
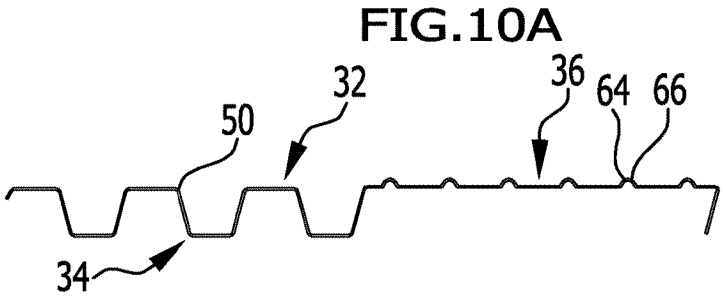
Figure 10B:
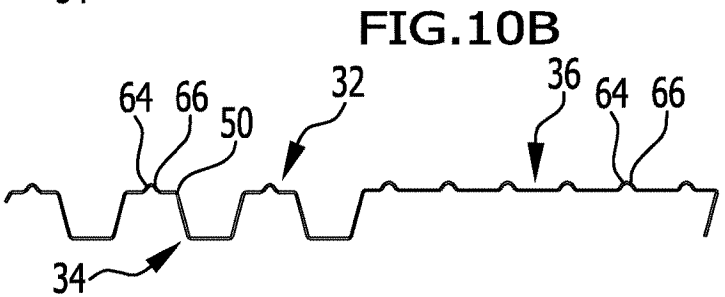

What the variants of the profile parts 32 in FIGS. 10A to 15D have in common is that they each comprise profile sections 34 having three projecting regions 50 and a covering section 36 and correspond in dimensions, for example, to the profile parts 32 of the parking platform 10, wherein the variant in accordance with FIG. 10B corresponds to the profile part 32 of the parking platform 10.

It is understood that the variants described in the following could also be used with profile parts having a different number of projecting regions 50 and different dimensions of the profile section 34 and the covering section 36, thus in particular also with the profile part 92.

In the variants in accordance with FIGS. 10A to 11D, the profile parts 32 each comprise projecting regions 50 with a trapezoidal cross section, as was already described above.

The profile parts 32 of the variants in accordance with FIGS. 12A to 13D each comprise projecting regions 50 with a rectangular cross section, wherein the legs 52 are aligned in parallel to each other and preferably the connecting region 42 is aligned in parallel to the legs 52.

The profile parts 32 in accordance with the variants of FIGS. 14A to 15D comprise projecting regions 50 with an in inverse trapezoidal cross sectional shape. The legs 52 of a respective projecting region 50 are inclined away from each other, such that said projecting region 50 widens toward the top. Dovetail-shaped regions of the profile parts 32 are formed between adjacent projecting regions 50.

Figure 11A:
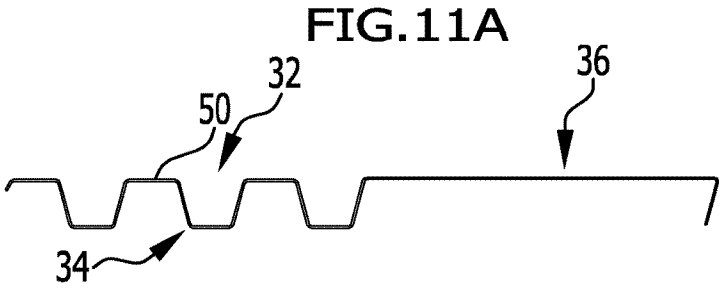
FIGS. 10A to 15D: each show a profile part of a parking platform in accordance with the invention in a side view.

The profile parts 32 of FIGS. 10A and 11A differ from each other in that, in the variant in accordance with FIG. 10A, profile elements 64 are present only on the covering section 36 and the variant in accordance with FIG. 11A is free of profile elements 64.

Figure 13A:
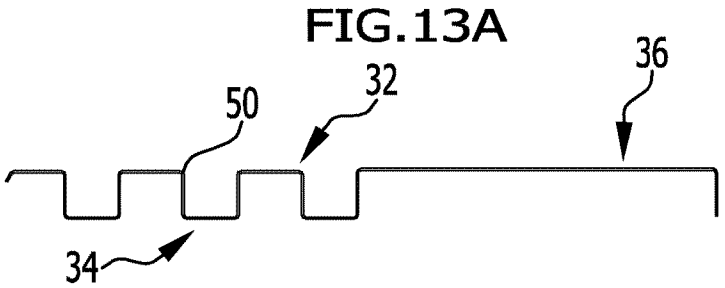
Figure 12A:
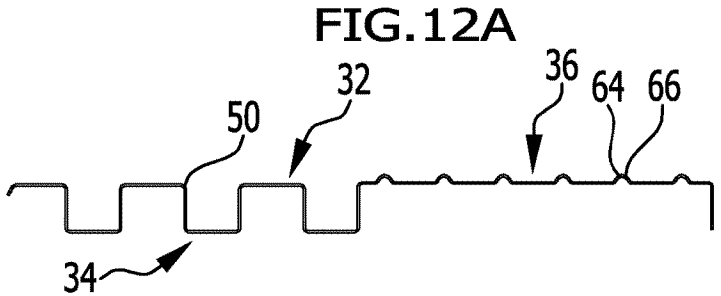
Figure 14A:
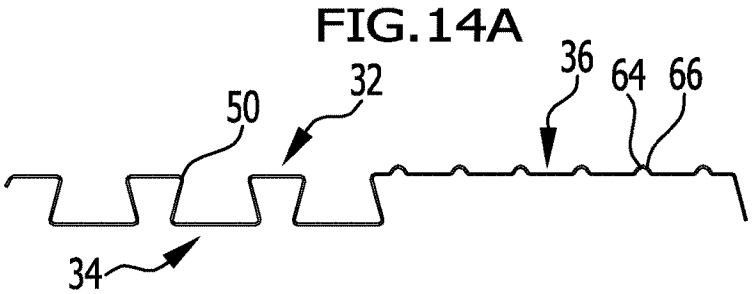
Figure 15A:
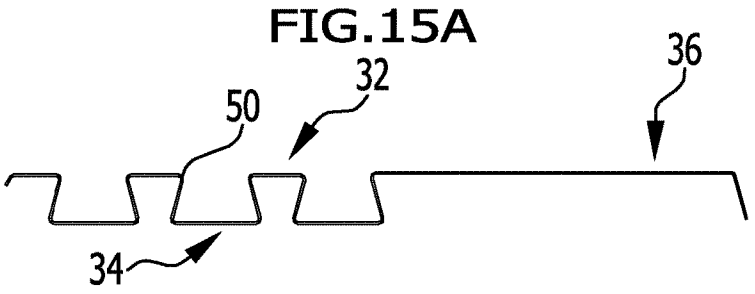

The same applies to the difference between the profile parts 32 in accordance with the variants of FIGS. 12A and 13A and between the variants in accordance with FIGS. 14A and 15A, respectively.

Figure 11B:
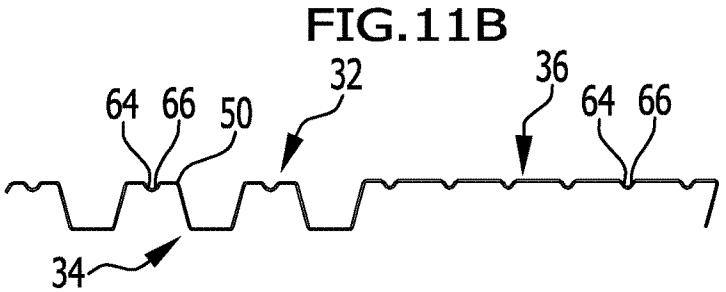
Figure 11C:
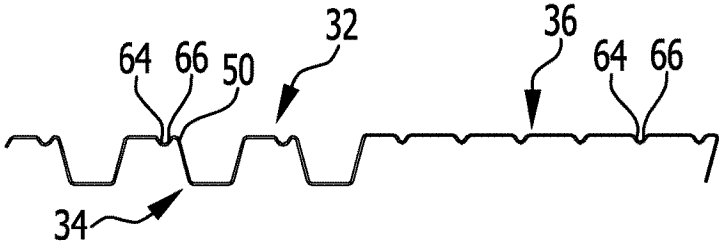
Figure 11D:
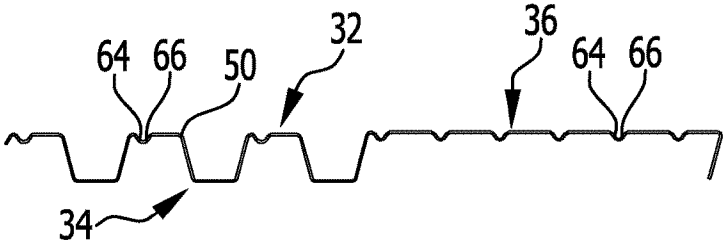
Figure 10C:
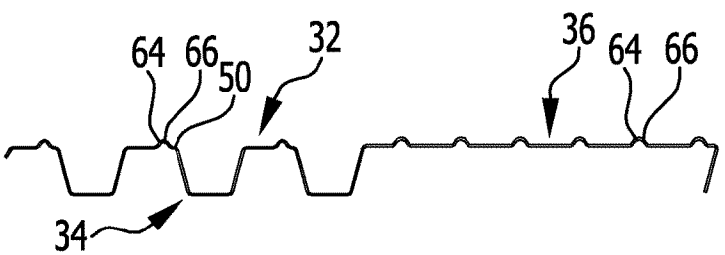
Figure 10D:
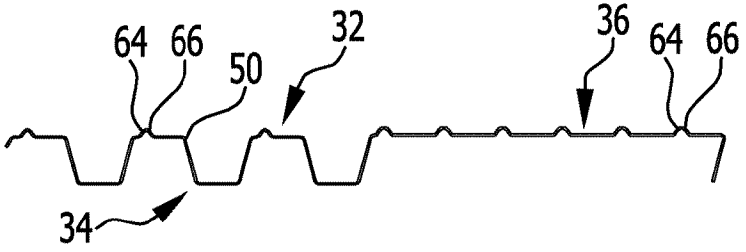

In the case of the profile parts 32 of the variants in accordance with FIGS. 10B, 10C, and 10D on the one hand, and FIGS. 11B, 11C, and 11D on the other hand, the difference is that the profile elements 64 in FIGS. 10B, 10C, and 10D project upward from the projecting regions 50 and the covering section 36, and in FIGS. 11B, 11C, and 11D project downwards, such that recesses are formed on the upper side of the profile parts 32.

Figure 12B:
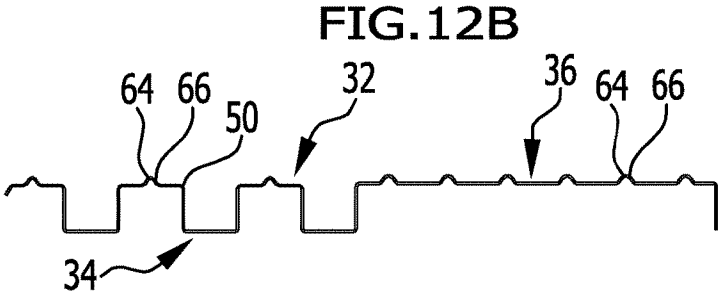
Figure 12C:
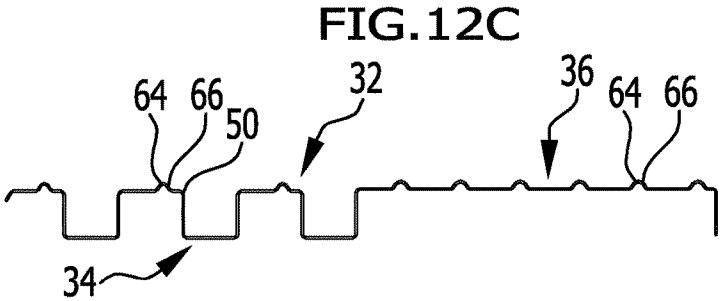
Figure 12D:
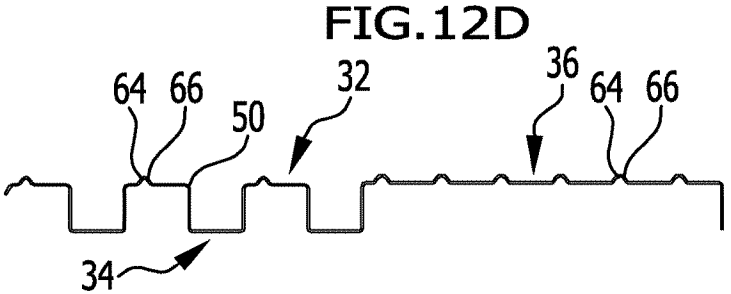
Figure 14B:
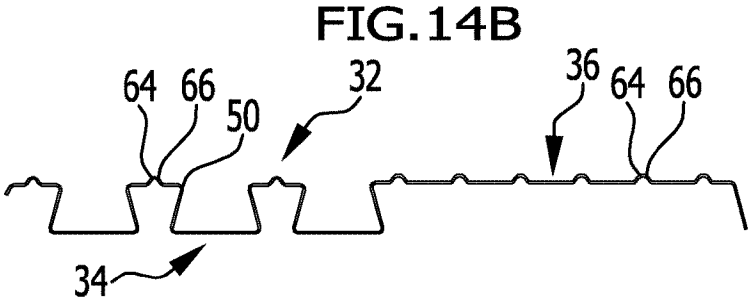
Figure 14C:
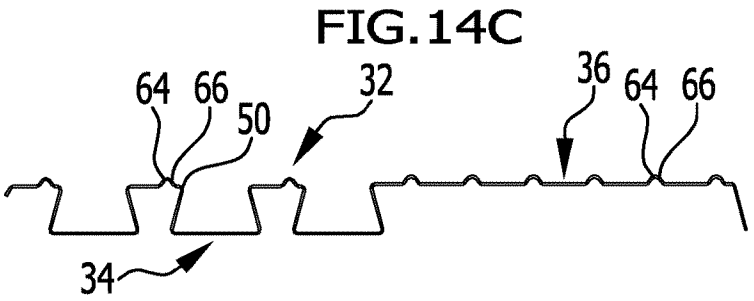
Figure 14D:
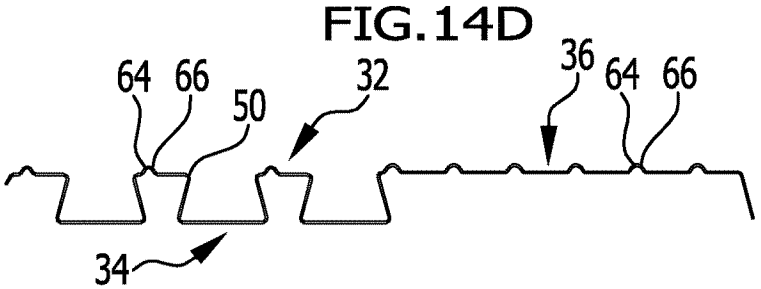

The same applies to the variants of the profile parts 32 of FIGS. 12B, 12C, and 12D on the one hand, and 13B, 13C, and 13D on the other hand, as well as to the variants of FIGS. 14B, 14C, and 14D on the one hand, and the variants 15B, 15C, and 15D on the other hand.

The difference between the variants in accordance with FIGS. 10B and 11B on the one hand and the variants of FIGS. 10C, 11C, 10D and 11D on the other hand is that, in the variants of FIGS. 10B and 11B, the profile elements 64 are arranged centrally on the projecting region 50 (in the longitudinal direction 12, the profile elements 64 of the covering sections 36 being positioned correspondingly). In contrast thereto, the profile elements 64 in FIGS. 10C, 11C, 10D, and 11D are positioned eccentrically in the longitudinal direction 12 on the projecting regions 50 (here too, the profile elements 64 of the covering sections 36 are arranged correspondingly).

Figure 13B:
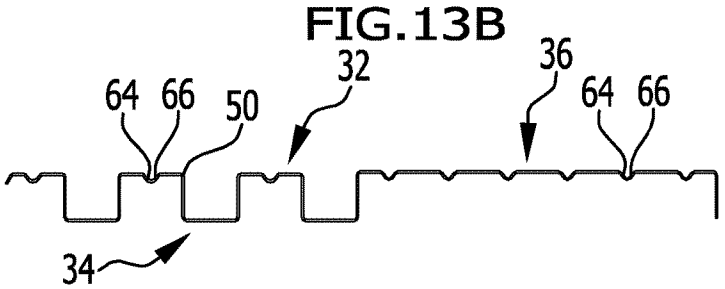
Figure 13C:
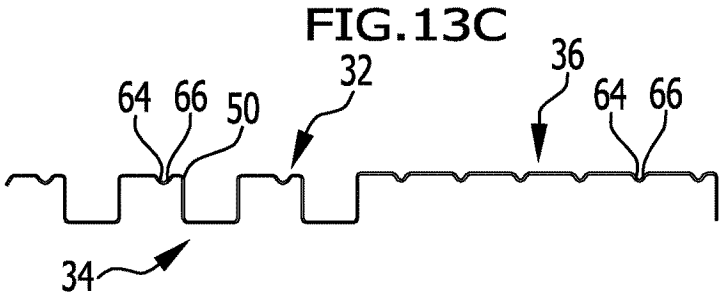
Figure 13D:
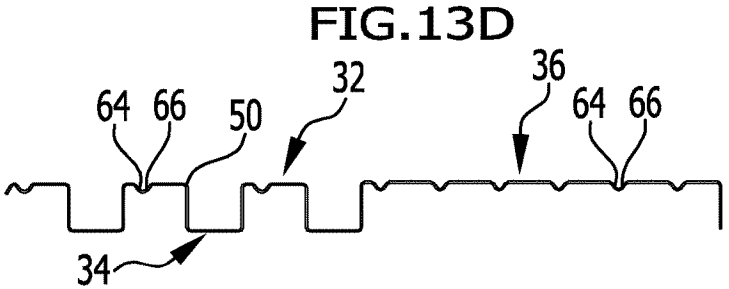
Figure 15B:
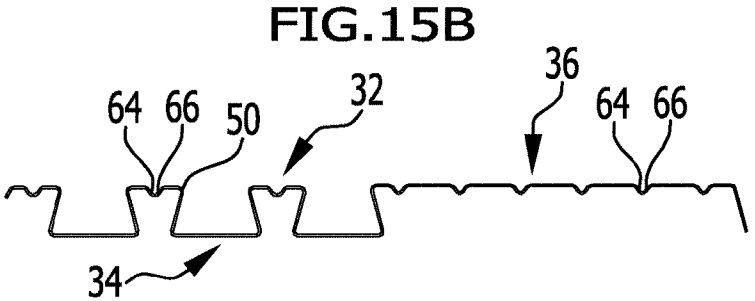
Figure 15C:
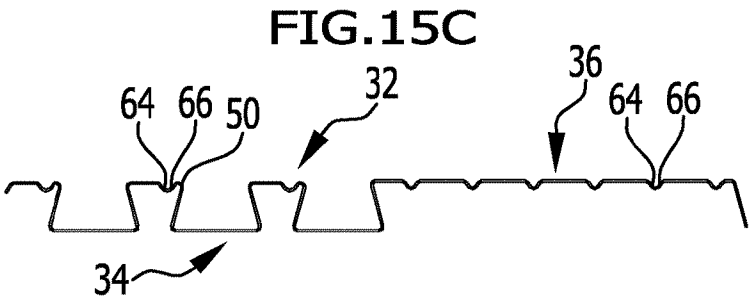
Figure 15D:
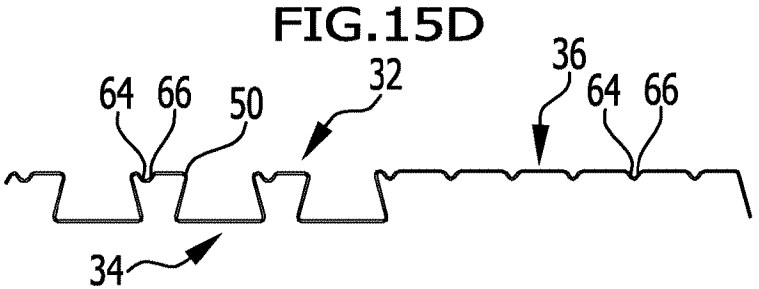

The same applies to the positioning of the profile elements 64 in the variants of FIGS. 12B and 13B on the one hand, and 12C, 13C, 12D, and 13D on the other hand, as well as to the variants of FIGS. 14B and 15B on the one hand, and the variants of FIGS. 14C, 15C, 14D, and 15D on the other hand.

REFERENCE NUMERAL LIST

10 parking platform
12 longitudinal direction
14 transverse direction
16 side cheek
18 transverse support
20 front end
22 connecting element
24 rear end
26 connecting element
28 bearing element
30 profile part
32 profile part
34 profile section
36 covering section
38 profile part
40 profile part
42 connecting region
44 first end
46 second end
48 base region
50 projecting region
52 leg
54 top element
56 shoulder
58 abutment region
60 gap
62 parking space
64 profile element
66 bead

68 covering section
80 parking platform
82 longitudinal support
90 parking platform
92 profile part
94 profile part
96 covering section

What is claimed is:

1. Parking platform for a motor vehicle, comprising:

profile parts which are arranged next to each other along a longitudinal direction of the parking platform and together form a parking space for the motor vehicle, wherein:

at least some of the profile parts comprise a respective profile section which has at least one base region and at least one projecting region, as well as a respective covering section which is arranged in the longitudinal direction next to the profile section and is connected thereto, each of the covering sections cover the at least one projecting region of an adjacent one of the profile parts, each of the covering sections rest on at least one projecting region of the profile section of the adjacent profile part;

the at least some of the profile parts comprise a plurality of the projecting regions and respective base regions arranged therebetween, and each of the covering sections cover all of the projecting regions and respective base regions arranged therebetween of the adjacent profile part.

2. The parking platform in accordance with claim 1, wherein each of the covering sections cover at least one projecting region and at least one adjoining base region of the adjacent profile part.

3. The parking platform in accordance with claim 1, wherein each of the covering sections cover or substantially cover an entire profile section of the adjacent profile part.

4. The parking platform in accordance with claim 1, wherein the at least some of the profile parts have a connecting region which connects the profile section and the covering section to each other, and wherein the covering section abuts with an abutment region against the connecting region of the adjacent profile part.

5. The parking platform in accordance with claim 1, wherein the covering section of one of the profile parts adjoins the covering section of the adjacent profile part, and wherein the parking space is substantially closed between the covering sections.

6. The parking platform in accordance with claim 1, wherein each of the covering sections is of plate-shaped or substantially plate-shaped configuration at least in sections.

7. The parking platform in accordance with claim 1, wherein an extent of each of the profile sections and an extent of each of the covering sections in the longitudinal direction are identical or are substantially identical.

8. The parking platform in accordance with claim 1, wherein the at least some of the profile parts each have a first end on which the at least one projecting region of the respective profile section is arranged, said at least one projecting region being covered by the covering section of the adjacent profile part.

9. The parking platform in accordance with claim 1, wherein the at least some of the profile parts have a second end on which an abutment region of the respective covering section is arranged for abutting against a connecting region of the adjacent profile part.

10. The parking platform in accordance with claim 1, wherein the at least one projecting region is configured to be trapezoidal, rectangular, or inversely trapezoidal in cross section.

11. The parking platform in accordance with claim 1, wherein the profile parts are extended along a transverse direction of the parking platform, wherein each of the covering sections cover the at least one projecting region of the adjacent profile part along an entire extent of the at least one projecting region in the transverse direction.

12. The parking platform in accordance with claim 1, wherein the at least some of the profile parts each comprise at least one additional projecting region.

13. The parking platform in accordance with claim 1, wherein two or more of the profile parts arranged next to each other are of identical configuration.

14. The parking platform in accordance with claim 1, wherein the parking platform is a single parking space platform and has side cheeks between which the profile parts are arranged and on which the profile parts are fixed.

15. The parking platform in accordance with claim 1, wherein the parking platform is a double parking space platform and has side cheeks and a longitudinal support, wherein the profile parts are each arranged between a side cheek and the longitudinal support.

16. The parking platform in accordance with claim 1, wherein the profile parts are configured as folded sheet metal parts.

17. The parking platform in accordance with claim 1, wherein the at least some of the profile parts comprise or form at least one profile element on at least one of the covering sections and on the at least one projecting region.

18. The parking platform in accordance with claim 17, wherein the profile elements are beads on at least one of the covering sections and on the at least one projecting region.

19. The parking platform in accordance with claim 17, wherein the at least one profile element, which is arranged on the projecting region of each of the at least some of the profile parts and on the covering section of the adjacent profile part, interengage.

20. The parking platform in accordance with claim 1, wherein the profile parts are connected to each other.

21. The parking platform in accordance with claim 1, wherein the at least some of the profile parts each comprise two or three projecting regions.

* * * * *